US005628685A

United States Patent [19]

Takemoto et al.

[11] Patent Number: 5,628,685

[45] Date of Patent: May 13, 1997

[54] GAME PLAY MEDIA LENDING MACHINE AND GAMING MACHINE SYSTEM EACH HAVING A CHARGE COLLECTION FUNCTION, AND CHARGE COLLECTION METHOD IN A GAMING HOUSE

[75] Inventors: Takatoshi Takemoto; Hiroshi Saito, both of Tokyo, Japan

[73] Assignee: Kabushiki Kaisha Ace Denken, Tokyo, Japan

[21] Appl. No.: 374,610

[22] PCT Filed: Jul. 21, 1993

[86] PCT No.: PCT/JP93/01013

§ 371 Date: Jan. 23, 1995

§ 102(e) Date: Jan. 23, 1995

[87] PCT Pub. No.: WO94/02221

PCT Pub. Date: Feb. 3, 1994

[30] Foreign Application Priority Data

Jul. 23, 1992 [JP] Japan ..... 4-197234

[51] Int. Cl.[6] ..... A63F 7/02

[52] U.S. Cl. ..... 463/25; 273/121 B; 273/138.2

[58] Field of Search ..... 273/121 B, 138 R, 273/138 A, 138.2, 138.1; 463/25, 16

[56] References Cited

FOREIGN PATENT DOCUMENTS

| | | | |
|---|---|---|---|
| 21970/88 | 9/1988 | Australia | 273/121 B |
| 2-142585 | 5/1990 | Japan . | |
| 3-15487 | 1/1991 | Japan . | |
| 3-21285 | 1/1991 | Japan | 273/121 B |
| 3-32686 | 2/1991 | Japan . | |
| 3-236877 | 10/1991 | Japan . | |
| 4-9174 | 1/1992 | Japan . | |
| 4-327874 | 11/1992 | Japan | 273/121 B |
| 5-3958 | 1/1993 | Japan | 273/121 B |
| 82/04340 | 12/1982 | WIPO . | |
| 9202415 | 11/1992 | WIPO | 273/121 B |

*Primary Examiner*—Benjamin H. Layno
*Attorney, Agent, or Firm*—Lowe, Price, LeBlanc & Becker

[57] ABSTRACT

A game play media lending machine which comprises an operation section which calculates based on the number of game play media read from a recording medium (C) and a predetermined lending unit price of a game play medium, a lending equivalent amount which is an amount of money required to receive dispensing of as many game play media as the number read from the recording medium from a game play media lending machine (20). The operation section also calculates a conversion amount that can be used for a player to borrow game play media based on the calculated lending equivalent amount and an exchange rate preset to collect a game play charge in proportion to the number of game play media won by the player. The operation section also calculates a difference between the calculated lending equivalent amount and the calculated conversion amount. The operation section then finds means for finding a remaining amount from the amount indicated by amount information output from a bill validator (22) and the conversion amount as an input amount and the amount indicated by amount specification information output from an amount selection switch (31) as a used amount. The operation section then outputs a dispensing instruction to a dispensing mechanism (34) based on the amount specification information output from the amount selection switch (31).

18 Claims, 9 Drawing Sheets

GAME PLAY MEDIA LENDING MACHINE AND GAMING MACHINE SYSTEM EACH HAVING A CHARGE COLLECTION FUNCTION, AND CHARGE COLLECTION METHOD IN A GAMING HOUSE

TECHNICAL FIELD

This invention relates to a game play media lending machine and a gaming machine system each having a charge collection function and a charge collection method in a gaming house and in particular to a game play media lending machine and a gaming machine system which can collect an additional charge when a player again uses previously won game play media to play a new game at a gaming machine and a charge collection method in a gaming house.

TECHNICAL BACKGROUND

A first collection method of game play charges in a gaming house containing gaming machines such as pinball machines or slot machines is to rent game play media to players.

By the way, when a player satisfies a given condition such as causing a game play medium (pinball) to enter a specific hole while playing a game at a gaming machine such as a pinball machine, a predetermined number of game play media are paid out to the player for a winning game play from the gaming machine. Therefore, as the player wins game plays, he or she holds an increasing number of game play media.

If the player quits playing when he or she holds a reasonable quantity of game play media, the player inputs the held game play media to a game play media counter for counting the number of game play media, and receives a receipt on which the count result is recorded. The player passes the receipt to a person at a prize exchange counter or window for exchanging it for a proper prize. At this time, exchangeable prizes are selected in the range of the conversion amount found by multiplying the lending amount, which in turn found by multiplying the number of game play media by the lending unit price, by a predetermined exchange rate allowing for a profit.

Therefore, when the player exchanges the won game play media for prizes, the gaming house can collect the charge corresponding to the number of the game play media.

By the way, some players might want to use the won game play media again to play a game at a gaming machine later, rather than to exchange them for prizes.

Then, for the convenience of such players, the gaming house can pay out game play media in exchange for a receipt on which the number of game play media is recorded so that the player can use the game play media to play a new game.

In this case, however, the following problems arise: First, it takes time and labor and is undesirable for personnel in the gaming house to receive the receipt and pay out as many game play media as the number recorded on the receipt manually, as a count error may occur. Second, if as many game play media as the number entered on the receipt are paid out as they are, the play charge cannot be collected from the player, which does not make for profitable business in the gaming house. In this case, personnel in the gaming house can also make a manual calculation to find the lending equivalent amount of game play media described above and multiply it by the exchange rate to find the conversion amount and pay out as many game play media as the number equivalent to the amount found manually. In this case, however, it takes more time and labor and is undesirable. Moreover, a calculation error may occur.

DISCLOSURE OF INVENTION

It is therefore an object of the invention to provide a game play media lending machine, a gaming machine system, and a charge collection method in a gaming house, whereby when a player uses a recording medium on which the number of won game play media is recorded to receive dispensed game play media and use them for playing a game, the game play media can be automatically dispensed using the recording medium on which the number of game play media is recorded and at that time, a necessary charge can also be automatically collected.

To this end, according to one form of the invention, there is provided a game play media lending machine being placed in a gaming house containing a gaming machine into which game play media are loaded for game execution and a game play media counter for counting game play media dispensed at the gaming machine and issuing a recording medium on which the number of game play media is recorded, for lending game play media used at the gaming machine, the game play media lending machine comprising:

- a recording medium reader for reading the number of game play media from information recorded on a recording medium inserted from outside;
- a controller having a memory, an operation section, and an output section for outputting the operation result to outside;
- a display for displaying amount information output from the controller;
- an amount selection switch for accepting specification of an amount of money for a player to borrow game play media and outputting information indicating the amount of money; and
- a mechanism for dispensing as many game play media as the number indicated from the controller, the operation section comprising:

- first operation means for calculating, based on the number of game play media read from the recording medium and a predetermined lending unit price of a game play medium, a lending equivalent amount which is an amount of money required to receive dispensing of as many game play media as the number read from the recording medium from the game play media lending machine;
- second operation means for calculating a conversion amount that can be used for a player to borrow game play media based on the calculated lending equivalent amount and an exchange rate preset to collect a game play charge in proportion to the number of game play media won by the player;
- third operation means for finding the remaining amount from the conversion amount as an input amount and the amount indicated by the amount specification information output from the amount selection switch as a used amount;
- means for causing the display to display an input amount before the remaining amount is calculated and the remaining amount after it is calculated; and
- dispensing control means for outputting a dispensing instruction to the dispensing mechanism based on the amount specification information output from the amount selection switch.

The game play media lending machine of the form can further include a bill validator for determining validity and denomination of a bill inserted from outside and outputting amount information. The third operation means can add the amount indicated by the amount information output from the bill validator and the conversion amount together to find an input amount and can find the remaining amount from the input amount and the amount indicated by the amount specification information output from the amount selection switch as a used amount.

The game play media lending machine can further include an adjustment switch for accepting an adjustment request when a game play ends, and a recording medium writer for issuing a recording medium onto which the remaining amount is written as record information when the adjustment switch is pressed.

In this case, the recording medium reader can further read the information indicating the remaining amount recorded on the recording medium.

The third operation means of the operation section can further add the remaining amount read from the recording medium as an input amount.

The game play media lending machine of the form can further include fourth operation means for calculating a difference between the lending equivalent amount and the conversion amount calculated by the second operation means. In this case, the output section can output the calculated difference to outside.

According to another form of the invention, there is provided a gaming machine system comprising a gaming machine into which game play media are loaded for game execution and a game play media lending machine for lending game play media used at the gaming machine, characterized in that the gaming machine comprises:

a game execution section for taking in a necessary number of game play media and executing a game play;

a game play media holding section for holding game play media used at the game execution section; and a dispensing mechanism responsive to a dispensing instruction from outside for counting a specified number of game play media supplied from outside and dispensing the game play media to the game play media holding section, and that the game play media lending machine comprises:

a bill validator for determining validity and denomination of a bill inserted from outside and outputting amount information;

a recording medium reader for reading the number of game play media from information recorded on a recording medium inserted from outside;

a controller having a memory, an operation section, and an output section for outputting the operation result to outside;

a mechanism for dispensing as many game play media as the number indicated from the controller; and a display for displaying amount information output from the controller;

an amount selection switch for accepting specification of an amount of money for a player to borrow game play media and outputting information indicating the amount of money; and the operation section comprising:

first operation means for calculating based on the number of game play media read from the recording medium and a predetermined lending unit price of a game play medium, a lending equivalent amount which is an amount of money required to receive dispensing of as many game play media as the number read from the recording medium from the game play media lending machine;

second operation means for calculating a conversion amount that can be used for a player to borrow game play media based on the calculated lending equivalent amount and an exchange rate preset to collect a game play charge in proportion to the number of game play media obtained by a player for winning game plays;

third operation means for finding the remaining amount from the conversion amount as an input amount and the amount indicated by the amount specification information output from the amount selection switch as a used amount;

means for causing the display to display an input amount before the remaining amount is calculated and the remaining amount after it is calculated; and dispensing control means for outputting a dispensing instruction to the dispensing mechanism based on the amount specification information output from the amount selection switch.

The gaming machine can further include a game play media collection and count section for taking in game play media held in the game play media holding section while counting the number of game play media upon receipt of an adjustment instruction. The game play media lending machine can further include an adjustment switch for accepting an adjustment request when game play is ended and outputting an adjustment instruction.

The operation section can further include game play media collection and count control means for outputting an instruction to the game play media collection and count section for commanding the collection and count section to collect and count game play media when the adjustment instruction is output. The invention can further include a recording medium writer for issuing a recording medium on which data is written.

In this case, after the adjustment instruction is output, the operation section can read the number of game play media from the game play media collection and count section and send the number of game play media and the remaining amount calculated by the third operation means to the recording medium writer as record information.

The recording medium reader can further read the information indicating the remaining amount recorded on the inserted recording medium.

The game play media lending machine of the form can further include fourth operation means for calculating a difference between the lending equivalent amount and the conversion amount calculated by the second operation means. In this case, the output section can output the calculated difference to outside.

According to another form of the invention, there is provided a charge collection method in a gaming house containing a gaming machine into which game play media are loaded for game execution, a game play media lending machine for lending game play media used at the gaming machine, and a game play media counter for counting game play media dispensed at the gaming machine and issuing a recording medium on which the number of game play media is recorded, the method comprising the steps of:

counting game play media won by a player at the gaming machine and recording information indicating the number of the game play media on a recording medium;

when the player again plays a game, reading the number of game play media recorded on the recording medium and multiplying the number by a lending unit price of a game play media to find a lending equivalent amount which is an amount of money required to receive as many game play media as the number read from the recording medium from the game play media lending machine;

calculating a conversion amount that can be used for the player to borrow game play media based on the found lending equivalent amount and an exchange rate preset to collect a game play charge in proportion to the number of game play media won by the player; and using the conversion amount as a part of the input amount when game play media are lent, thereby collecting the difference between the lending equivalent amount and the conversion amount as a charge.

The player receives a recording medium such as a card on which the number of game play media is recorded, for example, from the game play media counter for counting the game play media such as pinballs or medals won by the player. The player can play a game as if he or she used the won game play media by inserting the recording medium into the read section of the game play media lending machine.

At that time, the operation section of the game play media lending machine calculates the conversion amount based on the number of game play media, the lending unit price, and the exchange rate for the gaming house to automatically collect a charge, and an available amount of money is displayed on the display section as the remaining amount for the player. At that time, if another amount of money is input, it is added to the available amount of money to find the remaining amount. That is, the remaining amount indicates the amount of money that the player has input to the game play media lending machine.

To play a game, the player can handle the amount selection switch to receive game play media equivalent to any amount of money in the range of the amount displayed on the remaining amount display section. That is, when the player handles the amount selection switch, the counting section is instructed to dispense a predetermined number of game play media corresponding to the selected amount. At this time, the difference resulting from subtracting the selected amount from the amount displayed on the remaining amount display section is displayed on the remaining amount display section.

BEST MODE FOR CARRYING OUT THE INVENTION

Referring now to the accompanying drawings, there are shown embodiments of the invention.

Figures 2, 2A:
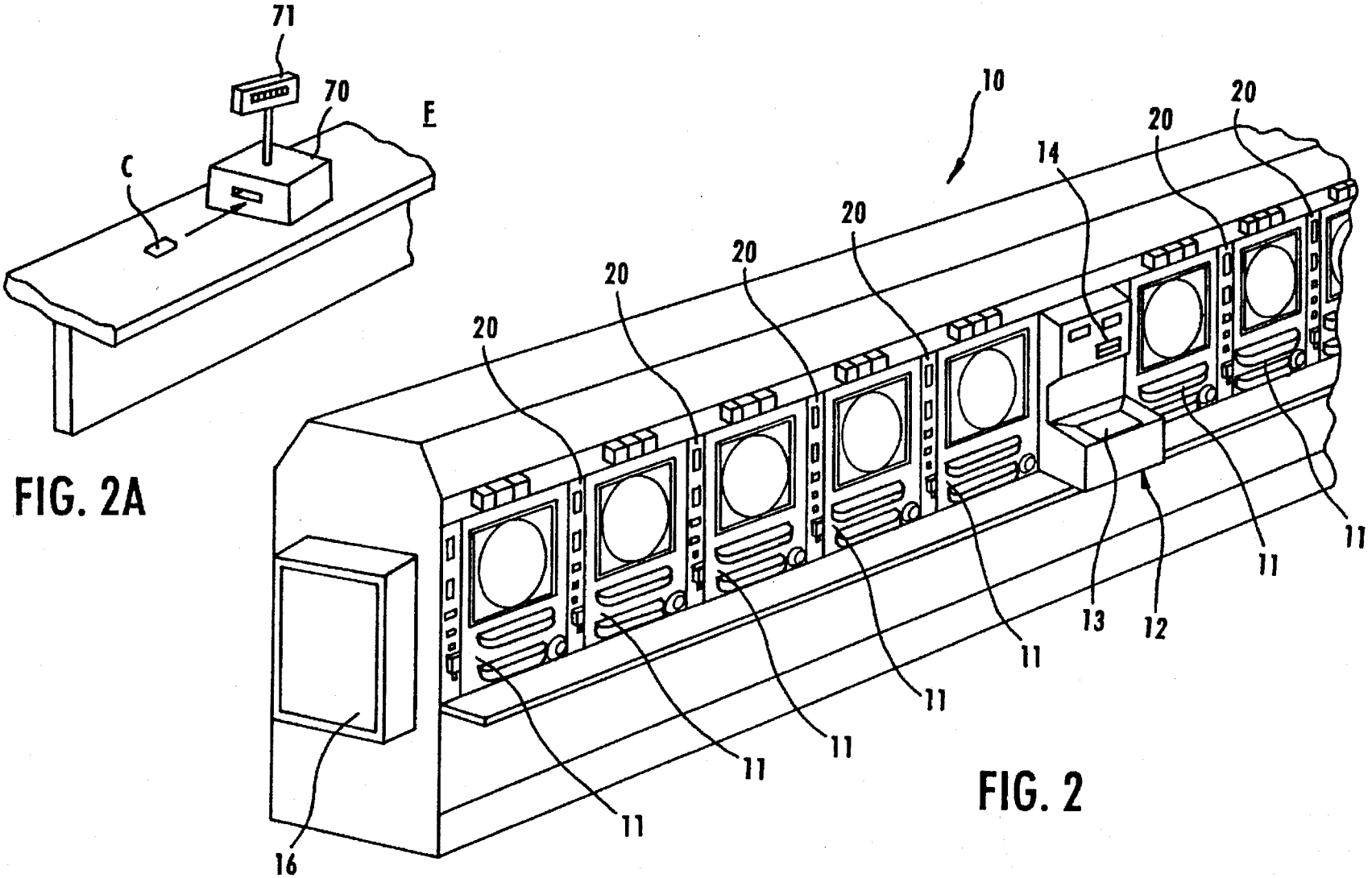
FIG. 2 is a perspective view showing a part of a layout of a gaming house containing a game island provided with the game play media lending machines in the first embodiment of the invention.

A first embodiment of the invention shown in FIG. 2 is an example applied to a gaming house containing a plurality of gaming machines 11 and a plurality of game play media lending machines 20.

Two rows of gaming machines 11 and game play media lending machines 20 placed alternately in a row face each other in opposite directions, making up a group. Such a group is called a game island. In FIG. 2, only the gaming machines 11 and the game play media lending machines 20 belonging to one row are shown. The gaming house contains a plurality of the game islands 10.

In the embodiment, the gaming machines 11 and the game play media lending machines 20 are separated from each other, but are assumed to be used in pairs. That is, one gaming machine 11 and one game play media lending machine 20 contiguous to each other make up one gaming machine system.

Figure 4:
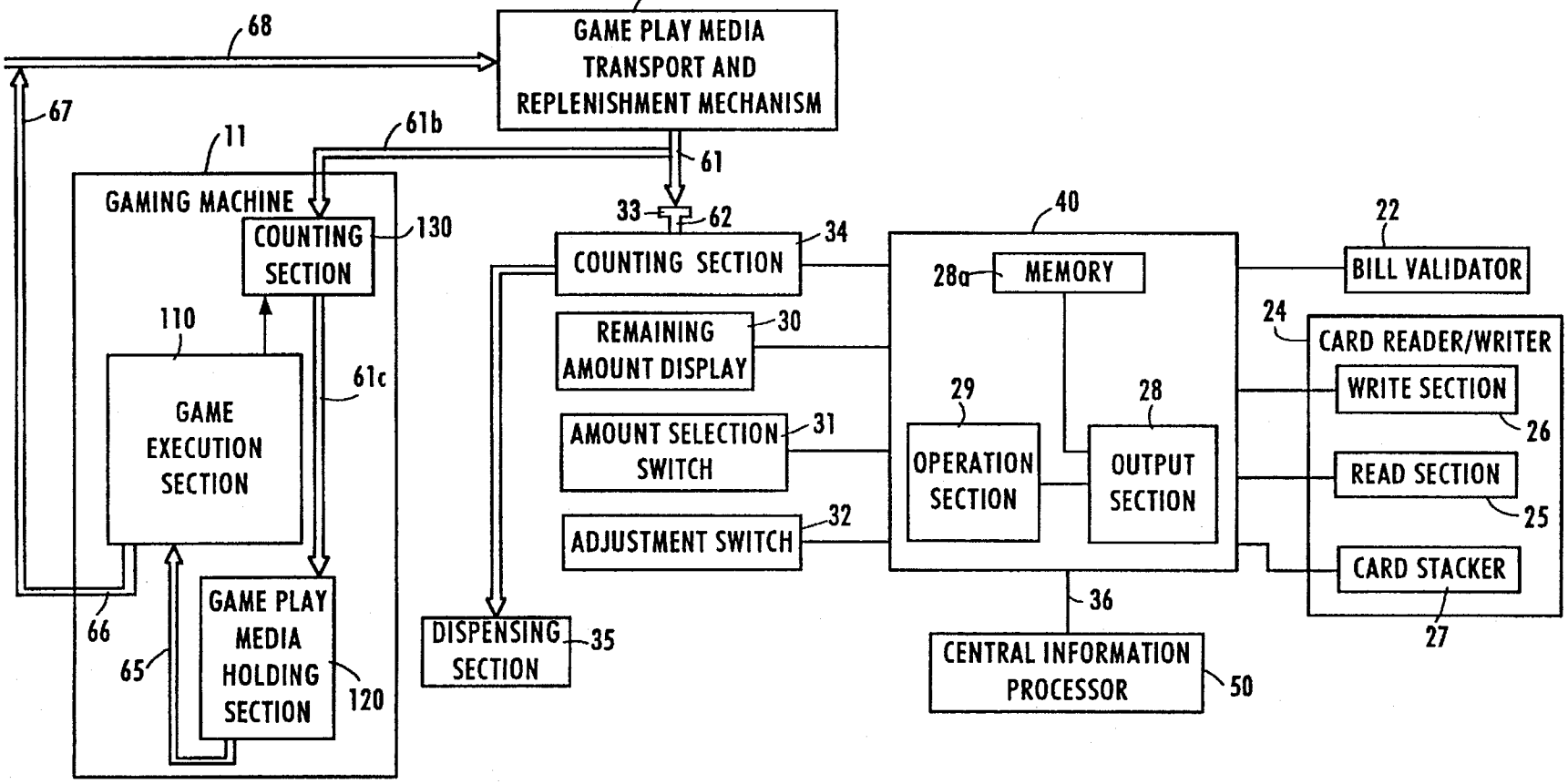
FIG. 4 is a block diagram showing the functions of the game play media lending machines and gaming machines in the first embodiment of the invention.

The game island 10 is provided with a game play media transport and replenishment mechanism 60 for supplying game play media to the gaming machines 11 and the game play media lending machines 20 and collecting the game play media input to the gaming machines 11 for reuse, as shown in FIG. 4.

The gaming machine 11 has a game execution section 110, a game play media holding section 120, and a counting section 130 functioning as a dispensing mechanism for counting game play media replenished from the game play media transport and replenishment mechanism 60 and paying them out to the game play media holding section 120. The counting section 130 pays out a necessary number of game play media as instructed from outside. In the embodiment, a predetermined number of game play media are paid out based on a signal indicating a win, sent from the game execution section 110.

Game play media required to play a game are taken into the gaming machine 11 via a passage member 65 from the game play media holding section 120. The game play media used to play a game are collected by the game play media transport and replenishment mechanism 60 via passage members 67 and 68.

For example, pinball machines, slot machines, etc., can be placed as the gaming machines 11. In the embodiment, pinball machines are placed. Therefore, pinballs are used as game play media. Of course, if other game machines are installed, game play media appropriate for the gaming machines, for example, medals are used.

The gaming house contains a prize exchange counter F, for example, as shown in FIG. 2. The prize exchange counter F is provided with a reader 70 for reading the number of game play media and the remaining amount information recorded on a card C described below. The reader includes a display 71 having front and rear display surfaces, for example.

A game play media counter 12 is disposed substantially at the center of the game island 10. The game play media counter 12 counts the game play media input through a game play media slot 13 and outputs the number of the game play media as information indicating the game play result. The game play media counter 12 has a card issuing section 14 for recording the game play result information on a card, which is a recording medium, and issuing the card. In the embodiment, the number of game play media is used as the game play result information. When a player inserts a card, the card issuing section 14 can also write the number of game play media onto the card.

Figure 1:
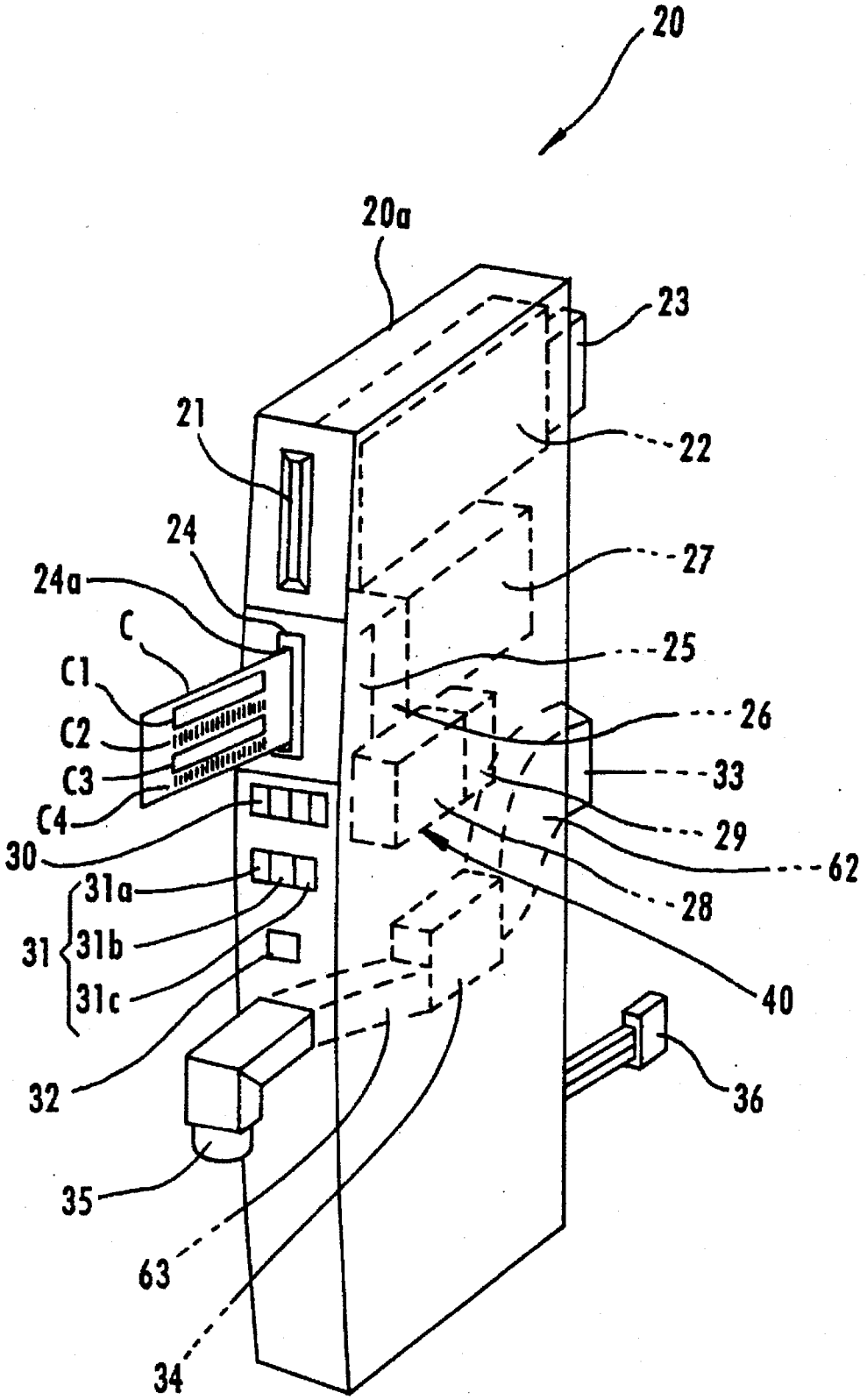
FIG. 1 is a perspective view showing a game play media lending machine in a first embodiment of the invention.

The card C has, as areas for indicating the number of game play media, an area C1 containing digits indicating the number and an area C2 containing a bar code indicating the number and, as areas for recording remaining amount information indicating the remaining amount to be adjusted at the time of game end, an area C3 containing digits indicating the amount and an area C4 containing a bar code indicating the number, as shown in FIG. 1; these indication entries can be rewritten.

The game play media lending machine 20 is a device for paying out game play media equivalent to the amount inserted by a player. As shown in FIG. 4, it comprises a bill validator 22 for determining the validity of bills inserted from the outside, a read section 25 and a write section 26 for reading and writing information from and onto a card C when the card C is inserted, a card stacker 27 for taking in, holding, and supplying cards C, a remaining amount display 30 for indicating the remaining amount of the input amount, an amount selection switch 31 for accepting selection of an amount for a player to borrow game play media from the gaming house, within the input amount, an adjustment switch 32 for accepting an instruction of adjusting the remaining amount, etc., at the time of game end, a counting section 34 functioning as a dispensing mechanism for counting the number of game play media to be lent and dispensing them, and a controller 40 for transferring information to and from the components and controlling them. These are provided in a machine body 20*a* or on the front thereof.

As shown in FIG. 1, a bill slot 21 is opened at the top of the front of the machine body 20*a* of the game play media lending machine 20. The bill slot 21 enables players to input one or more denominations of bills, such as 1000-yen, 5000-yen, and 10000-yen bills.

The bill (coin) validator 22 for determining the validity and denomination of an inserted bill is provided in the inside of the machine body 20*a* from the bill slot 21. The bill validator 22 sends a signal concerning the determined bill denomination to the controller 40.

A bill outlet 23 projecting backward from the machine body 20*a* is provided at the termination of the bill validator 22. The bill outlet 23 is connected to a bill transporter (not shown) contained in the game island 10. Bills discharged from the bill outlet 23 are transported to a bill storage stacker 16 (see FIG. 2) installed on one end of the game island 10 by the bill transporter. The bill storage stacker 16 can group bills into the three denominations for storage.

The game play media lending machine 20 is formed with a card inlet and outlet 24*a* below the bill slot 21 for taking a card C issued by the game play media counter 12 into the machine body 20*a*. Placed in the inside of the machine body 20*a* from the card inlet and outlet 24*a* is a card reader/writer 24 which has the read section 25 for reading the game play result information and remaining amount information recorded on the inserted card, the write section 26 for newly writing the number of game play media, the remaining amount information, and other necessary items onto one of the cards taken into the machine body 20*a*, and the card stacker 27 for stacking and storing the cards taken into the machine body 20*a*. The read section 25 comprises a scanner, for example, for reading bar codes. On the other hand, the write section 26 comprises a thermal head, for example, for thermally writing and erasing bar codes, etc., for recording them.

Cards formed with a magnetic recording section can also be used. In this case, the read section 25 is provided with a read head and the write section 26 is provided with a write head.

The read section 25 and the write section 26 may be separate devices, namely, a recording medium reader 25 and a recording medium writer 26. In this case, the card inlet and outlet 24*a* can be provided separately for each of the reader and the writer rather than being common to them. In this case, the card stacker 27 is preferably placed between the recording medium reader 25 and the recording medium writer 26.

The controller 40 has an operation section 28 comprising a CPU, etc., a memory 28*a* consisting of RAM, ROM, etc., an output section 29 for outputting information required for centralized management of the conversion result, etc., by the operation section 28, and an interface, not shown. The controller 40 is connected to a central information processor (hall computer) 50 for executing centralized management of the gaming machines 11 and the game play media lending machines 20 belonging to the game island 10.

The operation section 28 performs operations and control. For example, when receiving a signal concerning the number of game play media recorded on a card C from the read section 25, the operation section 28 converts the recorded number of game play media into an amount of money based on a predetermined exchange rate.

The memory 28*a* stores programs of the operation section 28, data required for operations, the operation results, etc. The output section 29 is connected to the operation section 28. It is adapted to transmit the difference calculated as a result of conversion by the operation section 28 as a sales signal to the central information processor 50 which executes centralized management of the game island 10. A signal cable 36 is attached to the controller 40 for connecting the controller 40 to the central information processor 50 to transfer signals therebetween.

As shown in FIG. 1, the remaining amount display 30 is provided below the card inlet and outlet 24*a*. It visually displays the amount of money output from the operation section 28. For example, when the operation section 28 converts the number of game play media recorded on a card C into an equivalent amount of money based on a predetermined exchange rate, the remaining amount display 30 displays the conversion amount as instructed from the operation section 28. It is made up of 7-segment LEDs, etc., for digital display of the amount of money into which the number of game play media is converted.

The game play media lending machine 20 is provided with the amount selection switch 31 below the remaining amount display 30 for a player to select any desired amount to borrow game play media. The amount selection switch 31 has a plurality of switch elements 31*a*, 31*b*, and 31*c* (in the embodiment, three) functioning independently of each other. These switch elements 31*a*, 31*b*, and 31*c* can be related to predetermined denominations of bills (coins) for lending game play media to players, for example, 100 yen, 500 yen, and 1000 yen. The switch element may be related to 200 or 300 yen rather than 100 yen. The amount selection switch 31 may comprise a switch element only for 1000 yen or may be made up of two switch elements for 500 yen and 1000 yen.

The switch elements 31*a*, 31*b*, and 31*c*, which are provided with an illuminating lamp, are controlled by the controller 40 so that when the switch elements can be selected, the corresponding lamps go on.

As shown in FIG. 4, the amount selection switch 31 is connected to the controller 40 which is adapted to instruct the counting section 34 to dispense as many game play media as the number equivalent to the amount of money selected by a player based on a signal from the amount selection switch 31 and also to instruct the remaining amount display 30 to display the result of subtracting the amount selected by the player from the amount of money displayed on the remaining amount display 30. Thus, the switch elements 31*a*, 31*b*, and 31*c* are assigned proper addresses. A table in which the correspondences between the addresses and denominations are stored is provided in the memory 28*a*, whereby when any switch element is turned on, the operation section 28 can know the selected amount of money from the table based on the address of the switch element.

The adjustment switch 32 for adjusting at the time of game end is provided below the money selection switch 31. The adjustment switch 32 outputs a game end signal to the controller 40. When receiving the signal, the controller 40 instructs the write section 26 to record the number of game play media equivalent to the amount of money displayed on the remaining money display 30 on a card C and to dispense the card C on which the information has been recorded.

A game play media dispensing port 35 extending forward from the machine body 20*a* is provided below the adjustment switch 32. The dispensing port 35 is connected to the counting section 34 by a passage member 63, and the counting section 34 is connected to a game play media replenishment reception port 33 protruding backward from the machine body 20*a* by a passage member 62. As shown in FIG. 4, the game play media transport and replenishment mechanism 60 is connected to the replenishment reception port 33 by a passage member 61.

Figure 5:
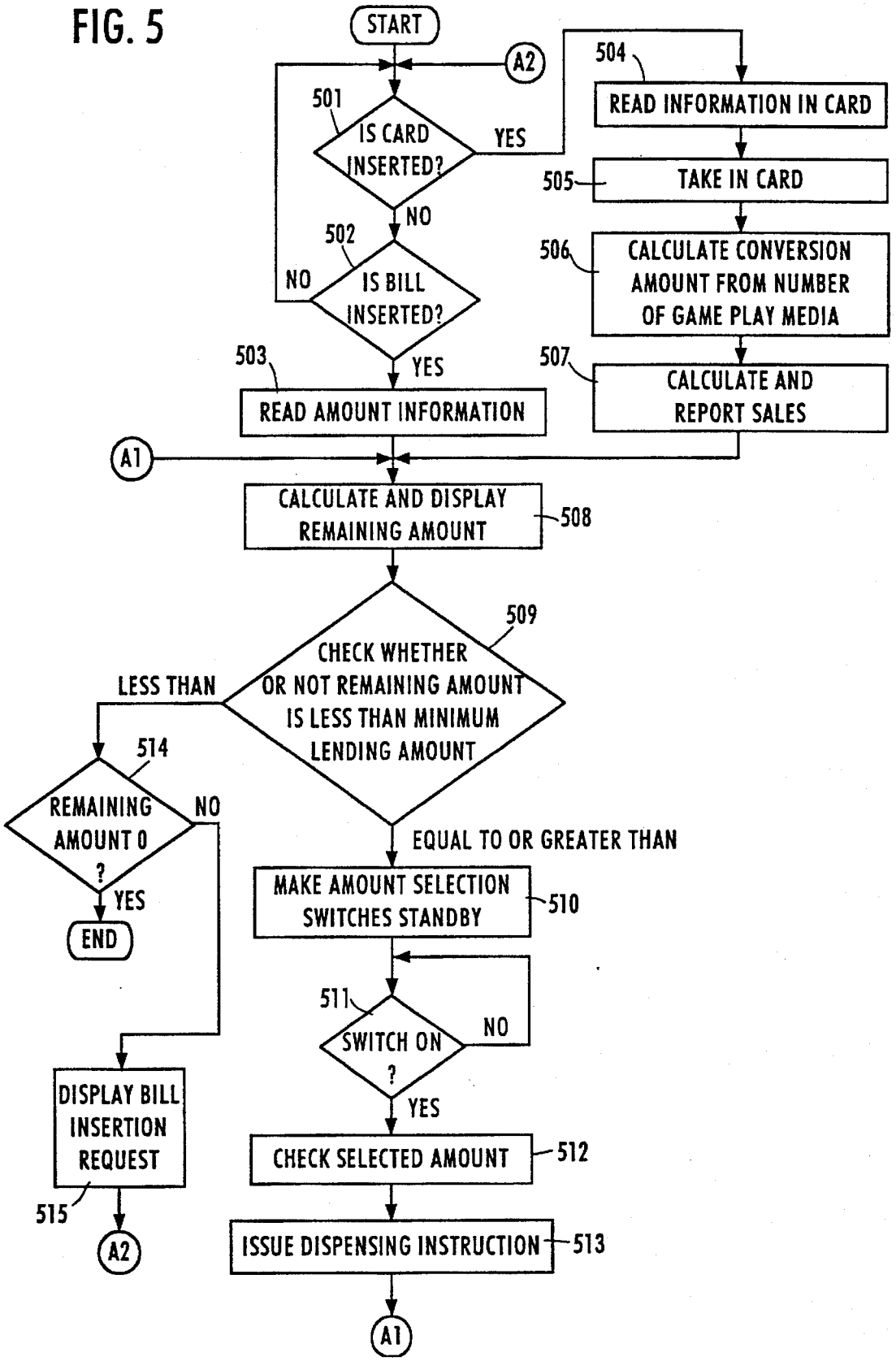
FIG. 5 is a flowchart showing the operation of a controller of the game play media lending machines in the first embodiment of the invention.
Figure 6:
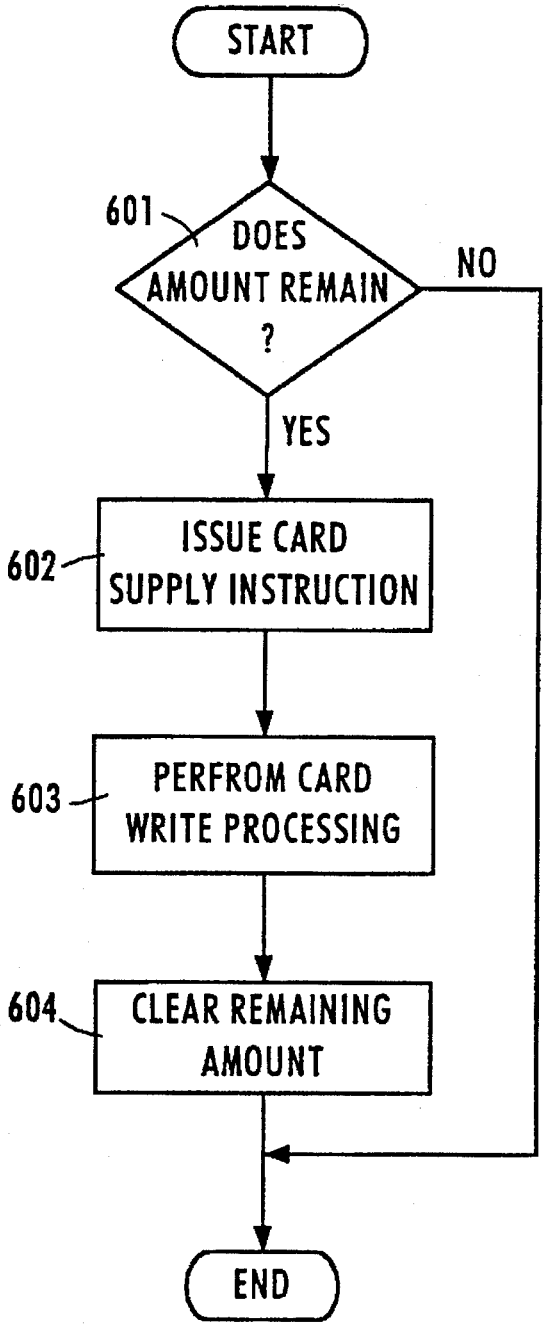
FIG. 6 is a flowchart showing the adjustment operation of the controller of the game play media lending machines in the first embodiment of the invention.

Next, the operation of the game play media lending machine 20 according to the embodiment will be discussed centering around FIGS. 5 and 6.

When the game play media lending machine 20 is started or the adjustment process described below terminates, the operation section 28 checks to see if a card C is inserted into the read section 25 at step 501. Also, it checks to see if a bill is input to the bill validator 22 at step 502.

When a player inserts a card C, the operation section 28 determines the validity of the card C and reads information recorded on the card C through the read section 22 and stores the information in the memory 28*a* at step 504. The operation section 28 erases the record contents by the write section 26 and instructs the card stacker 27 to take in the card at step 505.

The operation section 28 finds the amount into which the number of game play media is converted according to the following expression based on the information representing the number of game play media in the game play result information stored in the memory 28*a* at step 506:

Number of game play media×lending unit price=lending equivalent amount

Lending equivalent amount×exchange rate=conversion amount where the lending equivalent amount means the amount of money required to receive dispensing of the game play media from the game play media lending machine, the lending unit price is the amount of money per game play medium, set to collect a game play charge in accordance with the number of lent game play media, and the exchange rate is set to collect a game play charge in proportion to the number of game play media won by the player. The exchange rate may be set whenever necessary by the gaming house and prestored in the memory 28*a* or may be described in a program.

Further, the operation section 28 finds a difference between the lending equivalent money and the conversion amount. The result is transmitted to the central information processor (management computer) 50 as a part of the sales at step 507. On the other hand, the conversion amount is stored in a remaining amount storage area of the memory 28*a*. Then, control advances to step 508.

On the other hand, when a bill is inserted into the bill slot 21 of the game play media lending machine 20, first the bill validator 22 determines the validity of the bill. If the bill is valid, the bill validator 22 also determines the denomination thereof. A signal indicating that the bill has been input is sent from the bill validator 22 to the operation section 28. When receiving the signal, the operation section 28 reads amount information from the bill validator 22 at step 503. If the bill is valid, it is discharged through the bill outlet 23 and is stored in the bill storage stacker 16 on the end of the game island 10 by the bill transporter (not shown) disposed in the game island 10. If the bill is not valid, the bill validator 22 returns it to the bill slot 21.

Next, the operation section 28 reads the remaining amount information stored in the memory 28*a* and adds the conversion amount or the amount of the bill, the input amount from the outside to the remaining amount information. Then, the operation section 28 stores the found amount in the memory 28*a* as a new remaining amount and sends it to the remaining amount display 30 for displaying the amount at step 508.

Next, the operation section 28 compares the remaining amount with the minimum lending amount of game play media at step 509. If the remaining amount is less than the minimum lending amount, the operation section 28 checks whether or not the remaining amount is 0 at step 514 and if 0, it terminates the process. On the other hand, if the remaining amount is not 0, the operation section 28 displays a bill input request for prompting the player to input a bill and returns to step 501 (Step 515). In the embodiment, the bill input request is displayed by blinking a display on the remaining amount display 30.

On the other hand, if the remaining amount is equal to or greater than the minimum lending amount, the operation section 28 makes the switch elements 31*a*, 31*b*, and 31*c* operatively stand by in the range of the remaining amount, and turns on the corresponding lamps indicating that the switch elements are operative at step 509. Then, the operation section 28 checks to see if the player turns on any of the operative switch elements at step 510.

When any switch element is turned on, the operation section 28 looks up in the table from the address assigned to the switch element to find the selected amount at step 512, and instructs the counting section 34 to dispense as many game play media as the number corresponding to the amount of money at step 513. In response to the instruction, the counting section 34 takes in game play media from the game play media transport and replenishment mechanism and sends them to the dispensing port 35 while counting the number of game play media.

The operation section 28 subtracts the selected amount, namely, the amount used for the game play media from the remaining amount to find a new remaining amount, then stores it in the memory 28*a* and causes the remaining amount display 30 to display the new remaining amount at step 508. After this, similar operation is repeated.

When game play media are dispensed, the player can start playing a game. The game is executed at the game execution section 110 of the gaming machine 11. For game execution, the game execution section 110 takes in a necessary number of game play media from the game play media holding section 120. For a pinball game, one game play medium is taken in. The taken-in game play media are used for game execution, then are returned via passage members 66, 67, and 68 to the game play media transport and replenishment mechanism 60.

When the player meets a predetermined condition during the playing of a game at the game execution section 110, a signal (win signal) is sent to the counting section 130 for instructing a given number of game play media to be paid out to the player for a winning game play. When receiving the signal, the counting section 130 pays out the game play media to the game play media holding section 120. For the pinball machine shown in FIG. 3, the above-mentioned predetermined condition is that a pinball falls into any of holes 111*a* formed like pockets, and holes 111*b*, formed like petals at the game execution section 110.

Next, the operation performed when the adjustment switch 32 is pressed will be discussed with reference to FIG. 6.

In the embodiment, when the adjustment switch 32 is turned on, the operation section 28 is interrupted and upon completion of the current procedure being executed, starts an adjustment process.

First, the operation section 28 checks a predetermined area of the memory 28*a* to see if an amount remains at step 601. If the remaining amount of money is 0, the operation section 28 terminates the adjustment process. On the other hand, if an amount remains, the operation section 28 instructs the card stacker 27 to supply a card C to the write section 26 at step 602. It transfers information indicating the remaining amount of money to the write section 26 and instructs the write section 26 to write it onto the card C at step 603. Then, the operation section 28 clears the remaining amount stored in the memory 28*a* at step 604. The write section 26 writes the remaining amount onto the card C and discharges the card C to the card inlet and outlet 24*a*.

The player receives the card C and if game play media are held in the game play media holding section 120, transfers them to a box (not shown) and inputs them to the game play media slot 13 of the game play media counter 12 for counting the game play media. Then, the card C, on which the number of game play media as a result of the counting is indicated in digits and a bar code, is issued from the card issuing section 14. If the player has a card C discharged from the game play media lending machine 20, he or she may insert the card into the card issuing section 14 before inputting the game play media. Then, the counting result is indicated on the inserted card C.

The player can use the card to again play a game, in which case processing is performed as described above. The player can also take the card to the prize exchange counter F for exchanging the card for a prize. In this case, personnel in the gaming house load the card into the reader 70 for reading the number of game play media and the remaining amount information recorded on the card. These pieces of information are displayed on the display 71. The game play media, the number of which is recorded on the card, are exchanged for one or more prizes at a price equivalent to the conversion amount of money described above. The remaining amount is returned to the player in cash or a prize equivalent to the amount. For the game play media, cash as much as the conversion amount may be paid out to the player, if it is not a legal regulation.

Thus, according to the embodiment, after the game play media won by the player are counted by the game play media counter 12, the card issued from the game play media counter 12 can be used to exchange for a prize. If the player wants to again play a game, he or she can receive dispensing of game play media from the game play media lending machine 20. At this time, by multiplying an exchange rate, the gaming house can collect an additional game play charge from the player who wins games and continues playing another game.

Next, a second embodiment of the invention will be discussed.

Figure 7:
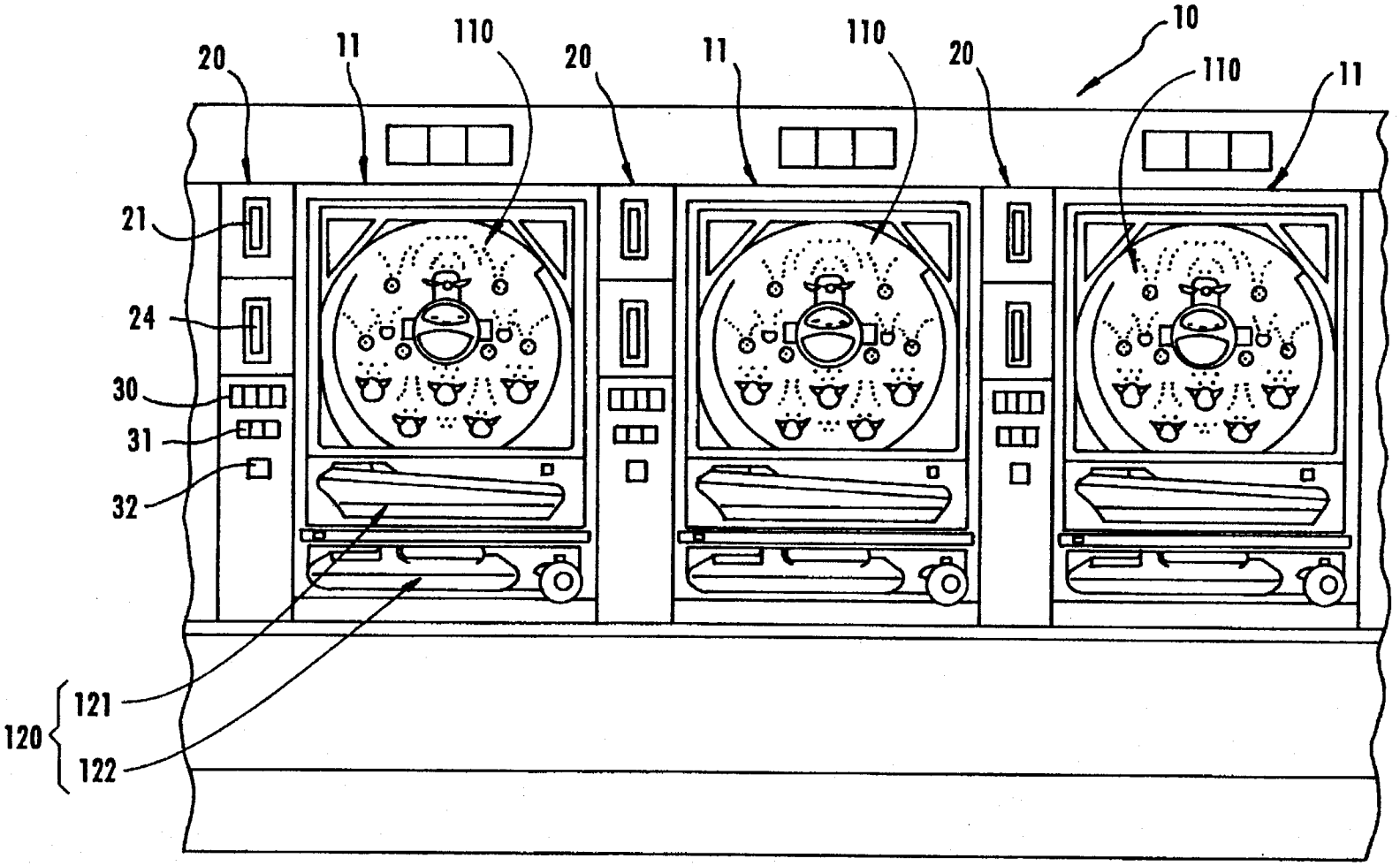
FIG. 7 is a front view showing a part of a game island provided with gaming machine systems in a second embodiment of the invention.
Figure 8:
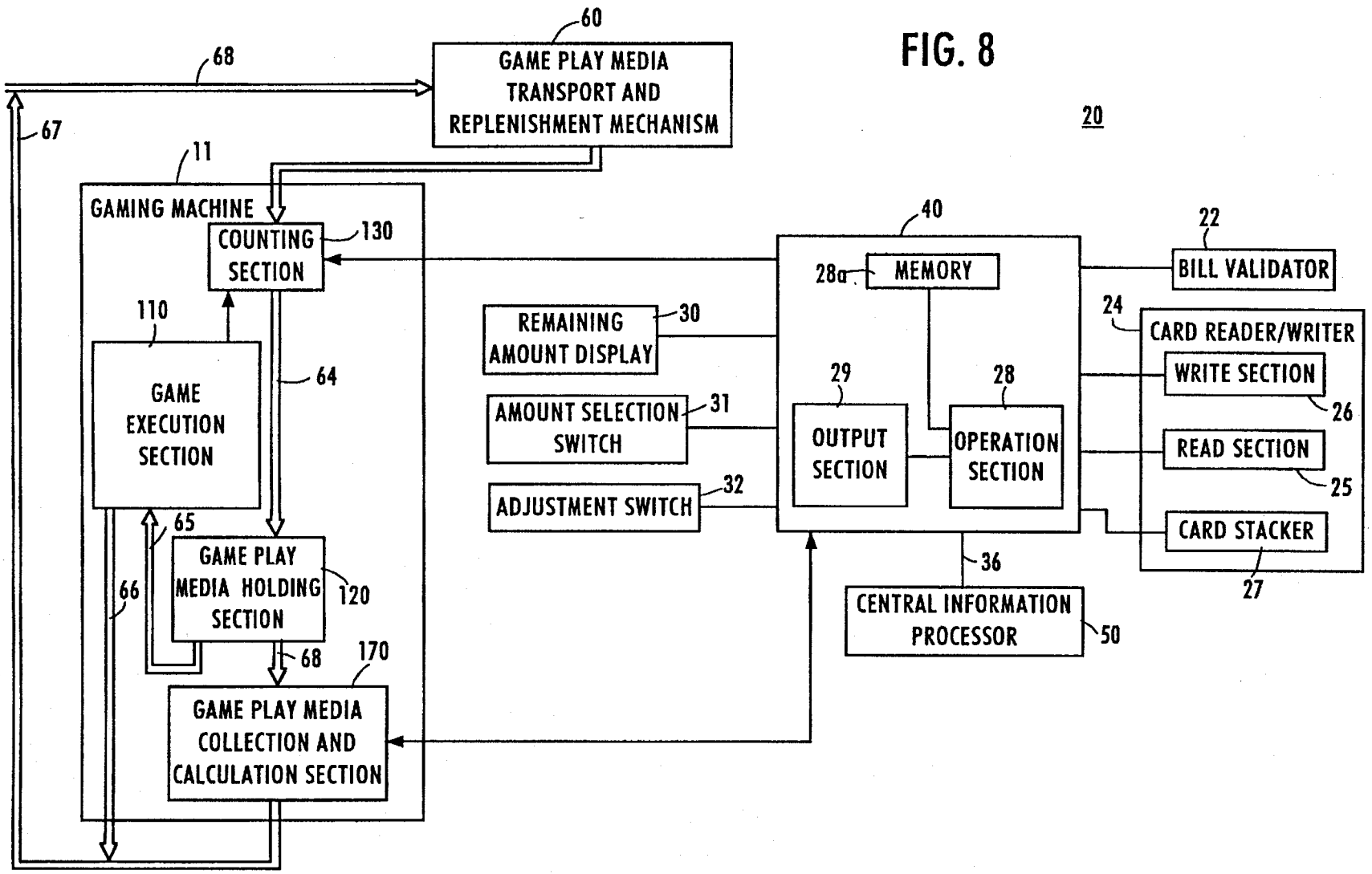
FIG. 8 is a block diagram showing the functions of game play media lending machines and gaming machines in the second embodiment of the invention.

FIG. 7 is a front view showing a part of the configuration of a game island to which the embodiment is applied. FIG. 8 is a block diagram showing the function of a game play media lending machine used with the embodiment and a flow of game play media in a gaming machine.

In the embodiment, a game play media lending machine 20 and a gaming machine 11 operate in functional association with each other in a pair to make up a gaming machine system. Specifically, the embodiment is characterized by the fact that lent game play media are dispensed directly to the gaming machine 11 from the game play media lending machine 20 and that game play media held in a game play media holding section are automatically collected while they are counted at the game end. The second embodiment is basically the same as the first embodiment in other points. In the second embodiment, a play dome 10 does not contain the game play media counter 12 in the first embodiment. A description will be given centering around the differences from the first embodiment.

In the second embodiment, the game play media lending machine 20 comprises a bill validator 22, a read section 25, a write section 26, a card stacker 27, a display section 30, an amount selection switch 31, an adjustment switch 32, and a controller 40 as components for providing various functions. These components are identical with those previously discussed in the first embodiment.

Figure 3:
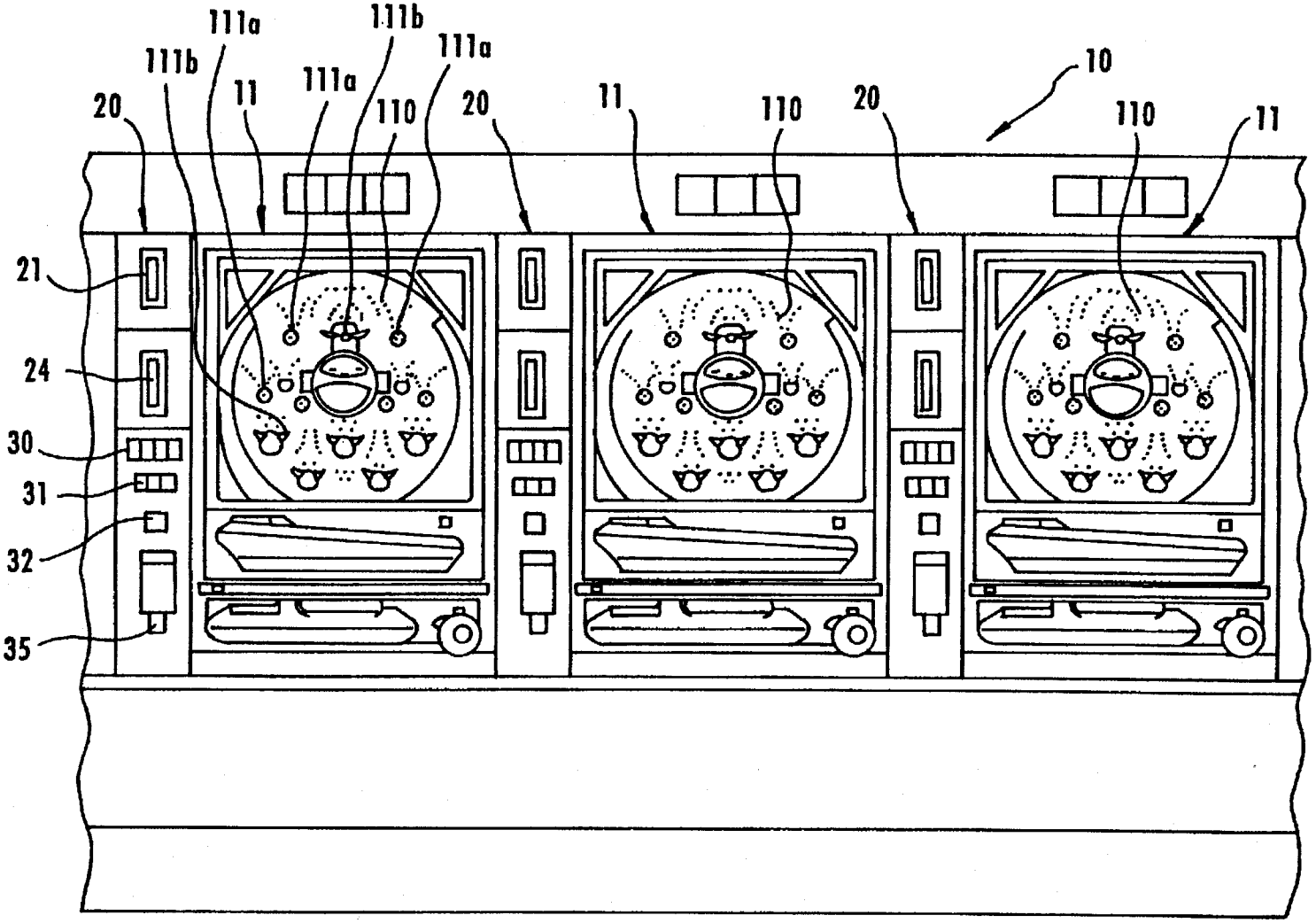
FIG. 3 is a plan view showing a part of the game island provided with the game play media lending machines in the first embodiment of the invention.

The game play media lending machine 20 of the second embodiment does not contain the dispensing port 35 or the counting section 34 of the game play media lending machine 20 shown in FIG. 3. As shown in FIG. 8, the game play media lending machine 20 used with the second embodiment does not dispense game play media directly from the machine itself. That is, in the embodiment, the game play media lending machine 20 only outputs a dispensing instruction to a counting section 130 of the gaming machine 11 for commanding the counting section 130 to dispense game play media to the game play media holding section 120.

In the embodiment, the gaming machine 11 has a game execution section 110, a counting section 130, a game play media holding section 120, and a game play media collection and calculation section 170. In the embodiment, game play media are supplied only to the gaming machine 11 and not to the game play media lending machine 20.

The game play media collection and calculation section 170 automatically takes in the game play media remaining in the game play media holding section at the game end and counts them. The counting result is sent to the controller 40 of the game play media lending machine 20.

Next, the operation of the embodiment will be described.

The operation of the game play media lending machine 20 is basically the same as in the first embodiment except that game play media are dispensed directly at the gaming machine 11 and for the adjustment operation. Here, a description will be given centering around the differences.

The game play media lending procedure of the game play media lending machine 20 is the same as that described with reference to FIG. 5 except that a dispensing instruction is output to the counting section 130 of the gaming machine 11 paired with the game play media lending machine 20 at step 513. When receiving the instruction, the counting section 130 dispenses a specified number of game play media from a game play media transport and replenishment mechanism 60 to the game play media holding section 120.

Figure 9:
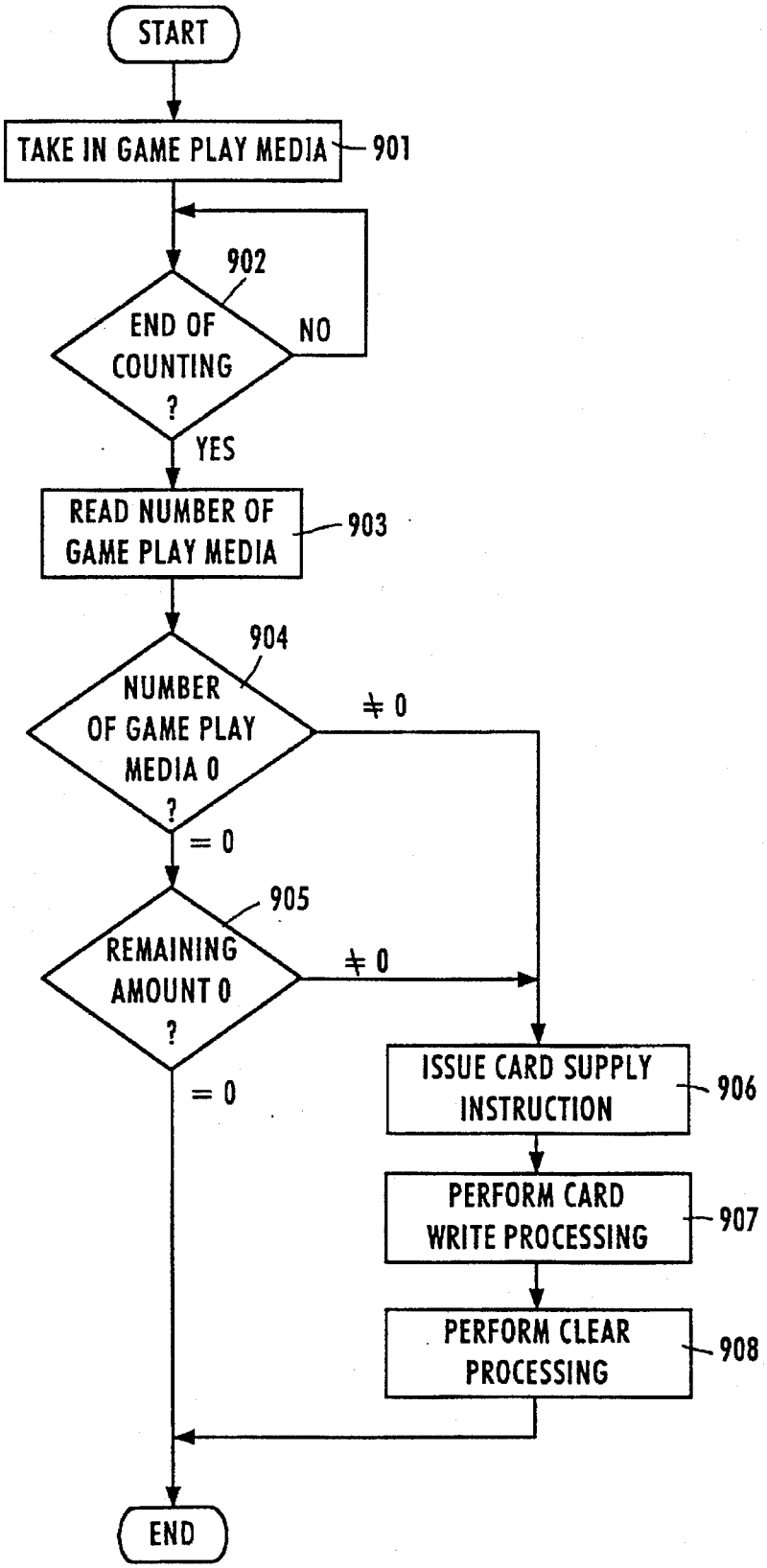
FIG. 9 is a flowchart showing the adjustment operation of a controller of the game play media lending machines in the second embodiment of the invention.

When the adjustment switch 32 is pressed, an operation section 28 executes an interrupt process and enters a process shown in FIG. 9.

First, the operation section 28 instructs the game play media collection and calculation section 170 to collect and count the game play media held in the game play media holding section 120 at step 901. The operation section 28 waits for the counting to end at step 902 before reading the number of game play media from the game play media collection and calculation section 170 at step 903.

Next, the operation section 28 checks whether or not the read number of game play media is 0 at step 904, and also checks whether or not the remaining amount stored in a predetermined area of a memory 28*a* is 0 at step 905. If both are 0, adjustment is not required and the process is terminated.

If at least one of them is not 0, the operation section 28 instructs the card stacker 27 to supply a card at step 906. The operation section 28 instructs the write section to write the number of game play media if not 0 and the remaining amount if not 0 into the corresponding regions of the card C in a bar code and digits at step 907, and clears the corresponding area of the memory 28*a* at step 908. The adjustment process is now complete.

In addition to rational game play charge collection as in the first embodiment, the second embodiment has the following effects: First, when game play media are lent from the game play media lending machine 20, they are dispensed directly to the game play media holding section 120 of the gaming machine 11, thus eliminating the need for a player to receive the game play media in a box at the dispensing port and transfer them to the game play media holding section 120. Second, a large number of game play media won by the player can be counted without carrying them to the game play media counter 12 in the first embodiment. Third, the first and second effects obviate the need for players to touch game play media, preventing the game play media from falling to the floor or becoming dirty.

In the first and second embodiments, the gaming machine and the game play media lending machine are separated from each other, but they can also be formed integrally.

In the embodiments, cards are held in the card stacker for reuse. However, the invention is not thus limited. For example, throwaway cards can also be used. If cards are reused, once used cards are not processed for reuse at the game play media lending machines and are gathered collectively for reuse processing, then may be again set in the card stacker 27.

What is claimed is:

1. A game play media lending machine being placed in a gaming house containing a gaming machine into which game play media are loaded for game execution and a game play media counter for counting game play media and issuing a recording medium on which the number of the game play media is recorded, for lending game play media used at the gaming machine, said game play media lending machine comprising:

a recording medium reader for reading the number of game play media from information recorded on a recording medium inserted from outside;

a controller having a memory, an operation section, and an output section for outputting the operation result to outside;

a display for displaying amount information output from said controller;

an amount selection switch for accepting specification of an amount of money for a player to borrow game play media and outputting information indicating the amount of money; and a mechanism for dispensing as many game play media as the number indicated from said controller, said operation section comprising:

first operation means for calculating based on the number of game play media read from the recording medium and a predetermined lending unit price of a game play medium, a lending equivalent amount which is an amount of money required to receive dispensing of as many game play media as the number read from the recording medium from said game play media lending machine;

second operation means for calculating a conversion amount that can be used for a player to borrow game play media based on the calculated lending equivalent amount and an exchange rate preset to collect a game play charge in proportion to the number of game play media won by the player;

third operation means for finding the remaining amount from the conversion amount as an input amount and the amount indicated by the amount specification information output from said amount selection switch as a used amount;

fourth operation means for calculating a difference between the lending equivalent amount and the conversion amount, means for causing said display to display an input amount before the remaining amount is calculated and the remaining amount after it is calculated; and dispensing control means for outputting a dispensing instruction to said dispensing mechanism based on the amount specification information output from said amount selection switch, said output section outputting the calculated difference to outside.

2. The game play media lending machine as claimed in claim 1 further including:

a bill validator for determining validity and denomination of a bill inserted from outside and outputting amount information, wherein said third operation means adds the amount indicated by the amount information output from said bill validator and the conversion amount together to find an input amount and finds the remaining amount from the input amount and the amount indicated by the amount specification information output from said amount selection switch as a used amount.

3. The game play media lending machine as claimed in claim 2 further including:

an adjustment switch for accepting an adjustment request when a game play ends; and a recording medium writer for issuing a recording medium onto which the remaining amount is written as record information when said adjustment switch is pressed.

4. The game play media lending machine as claimed in claim 3 wherein said recording medium reader further reads the information indicating the remaining amount recorded on the recording medium.

5. The game play media lending machine as claimed in claim 4 wherein said third operation means of said operation section further adds the remaining amount read from the recording medium as an input amount.

6. The game play media lending machine as claimed in claim 5 wherein said amount selection switch comprises a plurality of switch elements corresponding to specified amounts, and wherein said operation section further includes amount selection switch operation control means which makes operative, only switch elements that can be specified within the range of the remaining amount.

7. The game play media lending machine as claimed in claim 1 further including:

a bill validator for determining validity and denomination of a bill inserted from outside and outputting amount information, wherein said third operation means adds the amount indicated by the amount information output from said bill validator and the conversion amount together to find an input amount and finds the remaining amount from the input amount and the amount indicated by the amount specification information output from said amount selection switch as a used amount.

8. The game play media lending machine as claimed in claim 7 further including:

an adjustment switch for accepting an adjustment request when a game play ends; and a recording medium writer for issuing a recording medium onto which the remaining amount is written as record information when said adjustment switch is pressed.

9. The game play media lending machine as claimed in claim 8 wherein said recording medium reader further reads the information indicating the remaining amount recorded on the recording medium.

10. The game play media lending machine as claimed in claim 9 wherein said third operation means of said operation section further adds the remaining amount read from the recording medium as an input amount.

11. The game play media lending machine as claimed in claim 10 wherein said amount selection switch comprises a plurality of switch elements corresponding to specified amounts, and wherein said operation section further includes amount selection switch operation control means which makes operative only switch elements that can be specified within the range of the remaining amount.

12. A gaming machine system comprising a gaming machine into which game play media are loaded for game execution and a game play media lending machine for lending game play media used at the gaming machine, characterized in that said gaming machine comprises:

a game execution section for taking in a necessary number of game play media and executing a game play;

a game play media holding section for holding game play media used at said game execution section; and a dispensing mechanism responsive to a dispensing instruction form outside for counting a specified number of game play media supplied from outside and dispensing the game play media to said game play media holding section, and in that said game play media lending machine comprises:

a bill validator for determining validity and denomination of a bill inserted from outside and outputting amount information;

a recording medium reader for reading the number of game play media form information recorded on a recording medium inserted form outside;

a controller having a memory, an operating section, and an output section for outputting the operation result to outside;

a display for displaying amount information output from said controller;

an amount selection switch for accepting specification of an amount of money for a player to borrow game play media and outputting information indicating the amount of money;

a mechanism for dispensing as many game play media as the number indicated from the controller; and said operating section comprising:

first operation means for calculating based on the number of game play media read from the recording medium and a predetermined lending unit price of a game play medium, a lending equivalent amount which is an amount of money required to receive dispensing of as many game play media as the number read from the recording medium from said game play media lending machine;

second operation means for calculating a conversion amount that can be used for a player to borrow game play media based on the calculated lending equivalent amount and an exchange rate preset to collect a game play charge in proportion to the number of game play media obtained by a player for winning game plays;

third operation means for finding a remaining amount from the amount indicated by the amount information output from the bill validator and the conversion amount as an input amount and the amount indicated by the amount specification information output from said amount selection switch as a used amount;

fourth operation means for calculating a difference between the lending equivalent amount and the conversion amount, means for causing said display to display an input amount before the remaining amount is calculated and the remaining amount after it is calculated; and dispensing control means for outputting a dispensing instruction to said dispensing mechanism based on the amount specification information output from said amount selection switch, said output section outputting the calculated difference to outside.

13. The game machine system as claimed in claim 7 wherein said gaming machine further includes a game play media collection and count section for taking in game play media held in said game play media holding section while counting the number of the game play media upon receipt of an adjustment instruction, and wherein said game play media lending machine further includes an adjustment switch for accepting an adjustment request when game play is ended, and outputting an adjustment instruction.

14. The game machine system as claimed in claim 13 wherein said operation section further includes game play media collection and count control means for outputting an instruction to said game play media collection and count section for commanding the collection and count section to collect and count game play media when the adjustment instruction is output.

15. The gaming machine system as claimed in claim 14 further including:

a recording medium writer for issuing a recording medium on which data is recorded, wherein after the adjustment instruction is output, said operation section reads the number of game play media from said game play media collection and count section and sends the number of game play media and the remaining amount calculated by said third operation means to said recording medium writer as record information.

16. The game machine system as claimed in claim 15 wherein said recording medium reader further reads the information indicating the remaining amount recorded on the inserted recording medium.

17. The gaming machine system as claimed in claim 16 wherein said third operation means of said operation section further adds the remaining amount read from the recording medium as an input amount.

18. A charge collection method in a gaming house containing a gaming machine into which game play media are loaded for game execution, a game play media lending machine for lending game play media used at the gaming machine, and a game play media counter for counting game play media dispensed at the gaming machine and issuing a recording medium on which the number of the game play media is recorded, said method comprising the steps of:

counting game play media won by a player at the gaming machine and recording information indicating the number of the game play media on a recording medium;

when the player again plays a game, reading the number of game play media recorded on the recording medium and multiplying the number by a lending unit price of game play media to find a lending equivalent amount which is an amount of money required to receive dispensing of as many game play media as the number read from the recording medium from said game play media lending machine;

calculating a conversion amount that can be used for the player to borrow game play media based on the found lending equivalent amount and an exchange rate preset to collect a game play charge in proportion to the number of game play media won by the player, and using the conversion amount as a part of the input amount when game play media are lent; and calculating a difference between the lending equivalent amount and the conversion amount for outputting the difference as information representing the collected charge.

* * * * *